US008517754B2

(12) United States Patent
Shaw

(10) Patent No.: US 8,517,754 B2
(45) Date of Patent: Aug. 27, 2013

(54) CABLE ATTACHMENT HAVING A BODY CONTAINING A FLUID AND A PLUNGER FOR FIXING A CABLE TO THE BODY OR THE PLUNGER

(75) Inventor: Glen David Shaw, Conway, AR (US)

(73) Assignee: Perfectvision Manufacturing, Inc., North Little Rock, AK (US)

( * ) Notice: Subject to any disclaimer, the term of this patent is extended or adjusted under 35 U.S.C. 154(b) by 115 days.

(21) Appl. No.: 13/012,625

(22) Filed: Jan. 24, 2011

(65) Prior Publication Data

US 2011/0180177 A1 Jul. 28, 2011

Related U.S. Application Data

(60) Provisional application No. 61/297,803, filed on Jan. 24, 2010.

(51) Int. Cl.
*H01R 13/52* (2006.01)
*H01R 9/05* (2006.01)

(52) U.S. Cl.
USPC ..... 439/275; 439/582

(58) Field of Classification Search
USPC ..... 439/271–275, 578–585
See application file for complete search history.

(56) References Cited

U.S. PATENT DOCUMENTS

| | | | | |
|---|---|---|---|---|
| 5,941,736 | A | 8/1999 | Murakami | |
| 6,755,007 | B1 * | 6/2004 | Becker | 53/411 |
| 7,331,820 | B2 * | 2/2008 | Burris et al. | 439/578 |
| 7,448,895 | B1 * | 11/2008 | Linan | 439/271 |
| 7,828,596 | B2 * | 11/2010 | Malak | 439/578 |
| 8,047,872 | B2 * | 11/2011 | Burris et al. | 439/582 |
| 8,137,133 | B2 * | 3/2012 | Malak | 439/578 |
| 8,220,133 | B2 * | 7/2012 | Girard | 29/525 |

* cited by examiner

*Primary Examiner* — Chandrika Prasad
(74) *Attorney, Agent, or Firm* — Ocean Law; Paul D. Chancellor

(57) ABSTRACT

A cable attachment has a body and a plunger. During installation, a filling material binds the cable to the attachment.

27 Claims, 7 Drawing Sheets

CABLE ATTACHMENT HAVING A BODY CONTAINING A FLUID AND A PLUNGER FOR FIXING A CABLE TO THE BODY OR THE PLUNGER

PRIORITY CLAIM

This application claims the benefit of U.S. Provisional Patent Application No. 61/297,803 filed Jan. 24, 2010 and entitled CABLE ATTACHMENT WITH FILLING MATERIAL.

BACKGROUND OF THE INVENTION

1. Field of the Invention

The present invention relates to cable attachments. In particular, a component such as a connector is attached to a cable using a filling material that tends to prevent relative motion between the cable and a connector part.

2. Discussion of the Related Art

Cable attachments typically rely on deformation of some part of the attachment to fix the attachment to the cable. Solutions that avoid attachment deformation are rare despite applications that would benefit from non-deforming attachments.

SUMMARY OF THE INVENTION

A cable attachment utilizes a filling material to resist relative motion between the cable and the attachment. In an embodiment: a body has a reservoir at least partially surrounding a central cavity of the body and a plunger has a central cavity with an end portion of the plunger inserted in the reservoir; a cable is inserted in the body central cavity and the plunger central cavity such that an annular space is formed between the cable and at least one of the body and plunger central cavities; fluid communication between the reservoir and the annular space is enabled by a radial port in a sidewall of the reservoir and transport of a filling material from the reservoir to the annular space is caused by a movement of the plunger relative to the body; resistance to relative motion between the cable at least one of the body; and, the plunger is improved by the transport of the filling material.

In an embodiment, a cable attachment comprises: a body having a reservoir at least partially surrounding a central cavity of the body; a plunger having a central cavity, an end portion of the plunger inserted in the reservoir; a fluid in the reservoir, a quantity of the fluid capable of being expressed from the reservoir by operation of the plunger; the central cavities of the body and the plunger operable to receive an electrical cable; and, the fluid operable to limit relative motion between an electrical cable and at least one of the body and the plunger. Some of these embodiments include one or more of: a hollow post adapted for insertion in an end of a coaxial cable; the hollow post extending between a fastener and the body; a coaxial cable inserted in the central cavities of the body and the plunger; the body and the coaxial cable wetted by fluid expressed from the reservoir; the fluid operable to limit relative motion between the coaxial cable and the body; wherein operation of the plunger forms a fixed seal between the plunger and an outer jacket of the coaxial cable; wherein a fluid residue limits the relative motion between the coaxial cable and the body; a wall between the post and the reservoir; at least one port in the wall capable of passing the fluid in response to operation of the plunger; the fluid is a component of a single or multi-component adhesive; a mixing part for mixing with the fluid; the plunger operable to mix the mixing part and the fluid; a movable seal covering the at least one port; the seal capable of passing the fluid in response to operation of the plunger; the mixing part is air; and, the mixing part is a component of an epoxy adhesive.

In an embodiment a method of attaching a connector to a coaxial cable comprises the steps of: providing a connector body having an annular reservoir surrounding a central cavity; providing a connector plunger having a central cavity; supplying the reservoir with a fluid useful in an adhesive filling; sealing one end of the reservoir with one end of a plunger; inserting a coaxial cable in the central cavities of the body and the plunger; operating the plunger to express the fluid into a space separating the coaxial cable and at least one of the body and the plunger; and transforming a quantity of the fluid into a solid adhering to the coaxial cable and at least one of the body and the plunger. Some of these embodiments include one or more of step of coupling a fastener to the body via a hollow post; step of forming a seal between the plunger and an outer jacket of the coaxial cable when the plunger is operated; the step of locating a wall between the post and the reservoir; step of forming at least one port in the wall capable of passing the fluid in response to operation of the plunger; steps of providing a mixing part, when the plunger is operated, mixing the mixing part with the fluid to transform the fluid into the solid adhesive; steps of providing a port seal in the form of an elastomeric band, the port seal encircling the wall and covering the at least one port and, operating the seal to uncover the port when the plunger is operated; wherein the mixing part is air; and, wherein the mixing part is a component of an epoxy adhesive.

In an embodiment a cable attachment comprises: a fastener, a hollow post, and a body mechanically coupled together; the hollow post adapted for insertion in the end of a coaxial cable; the body having a reservoir at least partially surrounding a central cavity of the body; a plunger having a central cavity, an end portion of the plunger inserted in the reservoir; a fluid in the reservoir, a quantity of the fluid capable of being expressed from the reservoir by operation of the plunger; a coaxial cable inserted in the central cavities of the body and the plunger; and, the fluid operable to limit relative motion between the cable and at least one of the body and the plunger.

In an embodiment a cable attachment comprises: a body having a reservoir at least partially surrounding a central cavity of the body; a plunger having a central cavity, an end of the plunger inserted in the reservoir; a coaxial cable inserted in the central cavities of the body and the plunger; an annular space extending between the cable and a wall bounding the body central cavity; fluid communication between the reservoir and the annular space enabled by a port in a sidewall of the reservoir; movement of the plunger operable to transport a filling material from the reservoir to the annular space via the port; and relative motion between the cable and the body being resisted by the transported filling material.

BRIEF DESCRIPTION OF THE DRAWINGS

The present invention is described with reference to the accompanying figures. These figures, incorporated herein and forming part of the specification, illustrate embodiments of the invention and, together with the description, further serve to explain its principles enabling a person skilled in the relevant art to make and use the invention.

DETAILED DESCRIPTION OF THE PREFERRED EMBODIMENTS

The disclosure provided in the following pages describes examples of some embodiments of the invention. The designs, figures, and description are non-limiting examples of embodiments of the invention for teaching persons of ordinary skill in the art how to make and use the invention. For example, other embodiments of the disclosed systems and methods may or may not include the features described herein. Moreover, disclosed features, advantages, and benefits may apply to only certain embodiments of the invention and should not be used to limit the disclosed inventions.

Figure 1A:
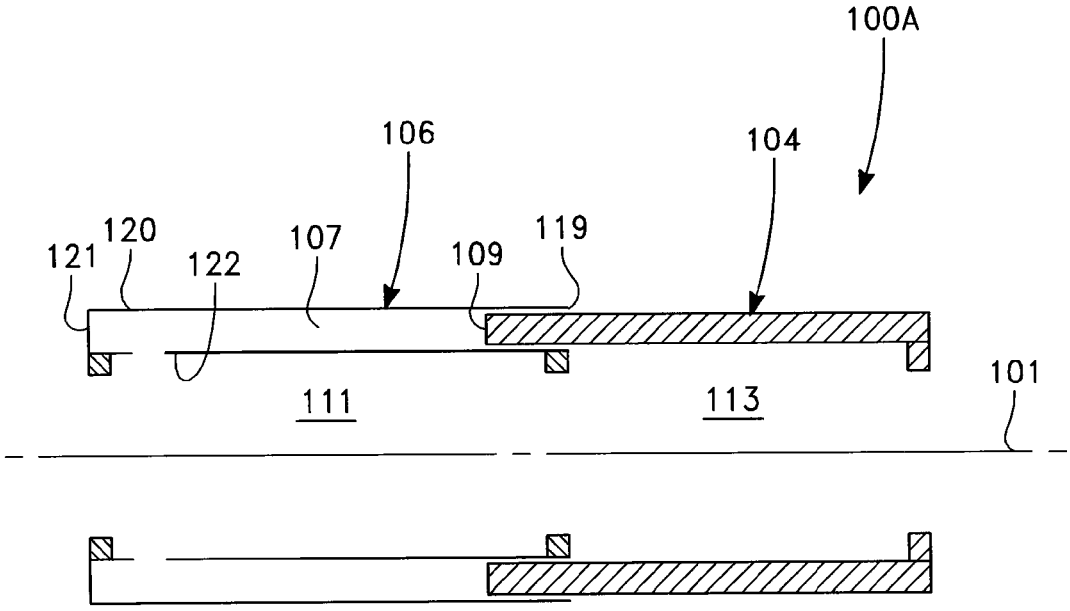
FIG. 1A shows a first cable attachment in accordance with the present invention.

FIG. 1A shows a cable attachment for use with filling material in accordance with the present invention 100A. Attachment parts include a body 106 and a plunger 104 arranged symmetrically about a central axis 101. The body has walls such as inner 122 and outer 120 walls bounding a reservoir such as an annular reservoir 107 and the reservoir surrounds all or a part of a body central cavity 111. The plunger 104 has a plunger central cavity 113 and an end face 109 shaped for insertion into an open end 119 of the reservoir. Opposite the open end of the reservoir is a closed reservoir end 121.

In an embodiment, the cable attachment 100A is made from one or more of metals and non-metals such as polymers known to persons of ordinary skill in the art to be suited for this use. Exemplary metals include brass, copper, steel, stainless steel, titanium, alloys of these metals, and other metals and their alloys known by persons of ordinary skill in the art to be suited to this use. In an embodiment the cable attachment is made from one or more metals such as brass. In another embodiment, the cable attachment is made from one or more polymers such as plastics. Exemplary plastics include polyoxymethylene ("POM"), polyvinyl chloride ("PVC"), high density polyethylene ("HDPE"), Polyphenylene Sulfide ("PPS"), liquid crystal polymer ("LCP"), polyester, thermoset materials (phenolics and epoxies) and other plastics known to persons of ordinary skill in the art to be suited to this use. In an embodiment, the plunger 104 is made from a metal such as brass and the body is made from a plastic such as polyoxymethylene ("POM").

Figure 1B:
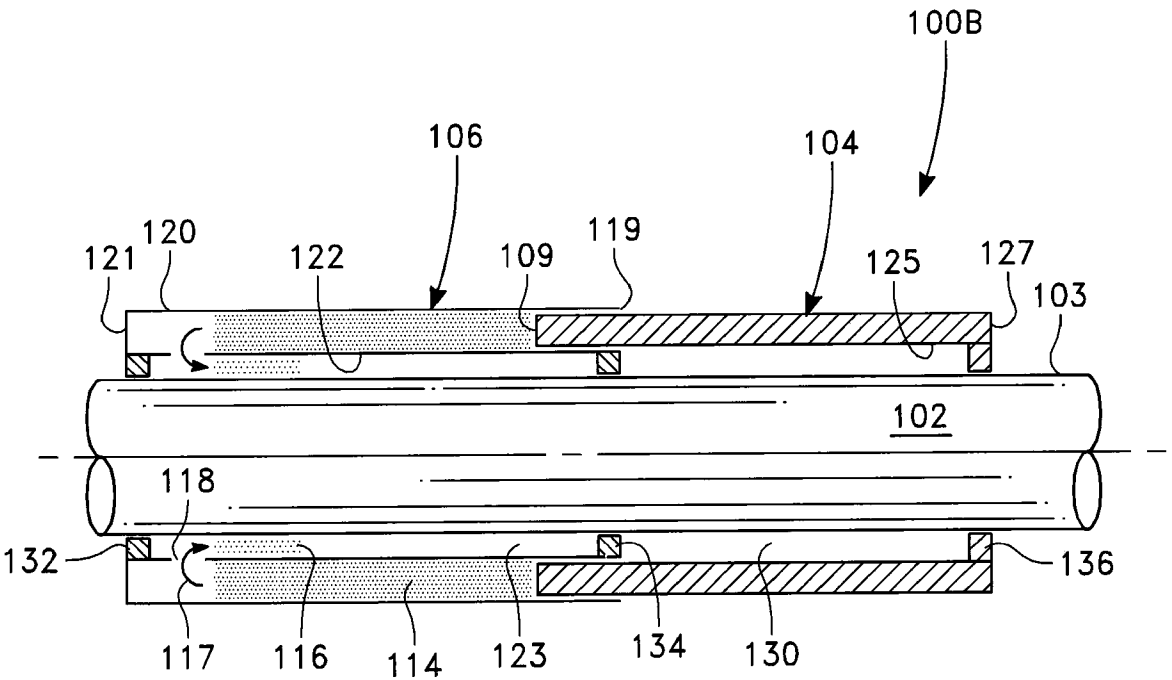
FIG. 1B shows the cable attachment of FIG. 1 with a cable inserted.
Figure 2:
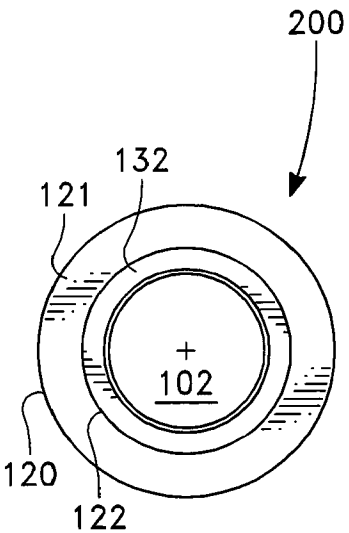
FIG. 2 shows an end view of the cable attachment of FIG. 1B.

FIG. 1B shows a cable inserted in the cable attachment 100B. In particular, a cable is inserted in the central cavities 111, 113 of the attachment body 106 and plunger 104. FIG. 2 shows an end view of the attachment and inserted cable 200.

A first filling material 114 is located in the reservoir 107 such that as the plunger is moved toward the closed end of the reservoir 121, an end face such as an annular end face of the plunger 109 causes the first filling material to flow 117 through one or more ports 118 in the inner wall of the body 122.

The plunger's end face 109 is opposite a cable entry end of the plunger 127. When a cable is located within the central cavities of the body and plunger 111, 113, annular spaces 123, 130 are formed between the cable exterior 103 and each of the inner body wall 122 and a plunger inner surface 125. At least a portion of the annular space between the cable exterior and the body inner wall is an annular fill space 123.

Moving the plunger toward the reservoir closure 121 causes the first filling material 114 to flow through the body inner wall ports 118 and to enter the annular fill space 123. In some embodiments, only a first filling material is used. In other embodiments a second filling material 116 is also used. For example, the second filling material can be located in the fill space before the second filling material enters the fill space (as shown).

In other embodiments, both the first and second filling materials 114, 116 flow through the ports 118 by action of the plunger 104. In some embodiments, a valve(s) such as a rubber ring or flap is associated with one or more ports 118 and movement of the plunger 104 opens the valve(s). (See infra.) This arrangement provides one solution for isolating the first fill material 114 from air, as with an air actuated filling material.

Filling material 114, 116 in the annular fill space 123 is contained by sealing structure(s), viscosity, or other means known to persons of ordinary skill in the art. In some embodiments, sealing structures are adjacent to and/or abutting the cable. In various embodiments, one or more sealing structures are used such as a first seal 132 located between the cable 102 and the inner wall of the body 122 near the body closure 121, a second seal 134 located between the cable and the inner wall of the body 122 near the open end of the reservoir 119, and a third seal 136 located between the cable and the inner wall of the plunger 125 near the cable entry end of the plunger 127.

It is not necessary for filling materials to completely fill the fill space 123. For example, to the extent the filling material(s) 114, 116 expand and press against the cable exterior 103 and the body 106, relative motion between the cable 102 and the body or attachment 100B is limited. And, for example, to the extent the filling materials(s) adhere to the cable exterior and the body or attachment, relative motion between the cable and the body is limited.

Filling materials include materials known to persons of ordinary skill in the art as being suitable for restraining, adhering, and/or binding the cable 102 to the body 106 and/or to the attachment 100A-B. Exemplary filling materials include adhesives such as single and multiple component adhesives and volume expanding fillers.

In particular, filling materials include single and multipart adhesives. Single part adhesives include cyanoacrylate type adhesives such as Krazy Glue®. Two part adhesives include two-part epoxy adhesives such as 3M® Scotch Weld® adhesives including electrical grade adhesives and 3M's quick setting DP100 and DP105 adhesives. Yet another two-part epoxy adhesive is sold by ND Industries, Inc., Troy Mich., under the brand name ND Microspheres® 294, a micro-encapsulated epoxy product.

Filling materials also encompass volume expanding fillers such as single and multipart fillers including expanding foams. Suitable expanding foams include polyisocyanurate and polyurethane two-component expanding sealants from Fomo Products, Inc. of Norton, Ohio sold under the Silent Seal® brand. Yet another two-component expanding polyurethane foam sealant is available from American Industrial Supply Inc. of Burbank, Calif. under the brand AMER-FOAM.

Figure 3:
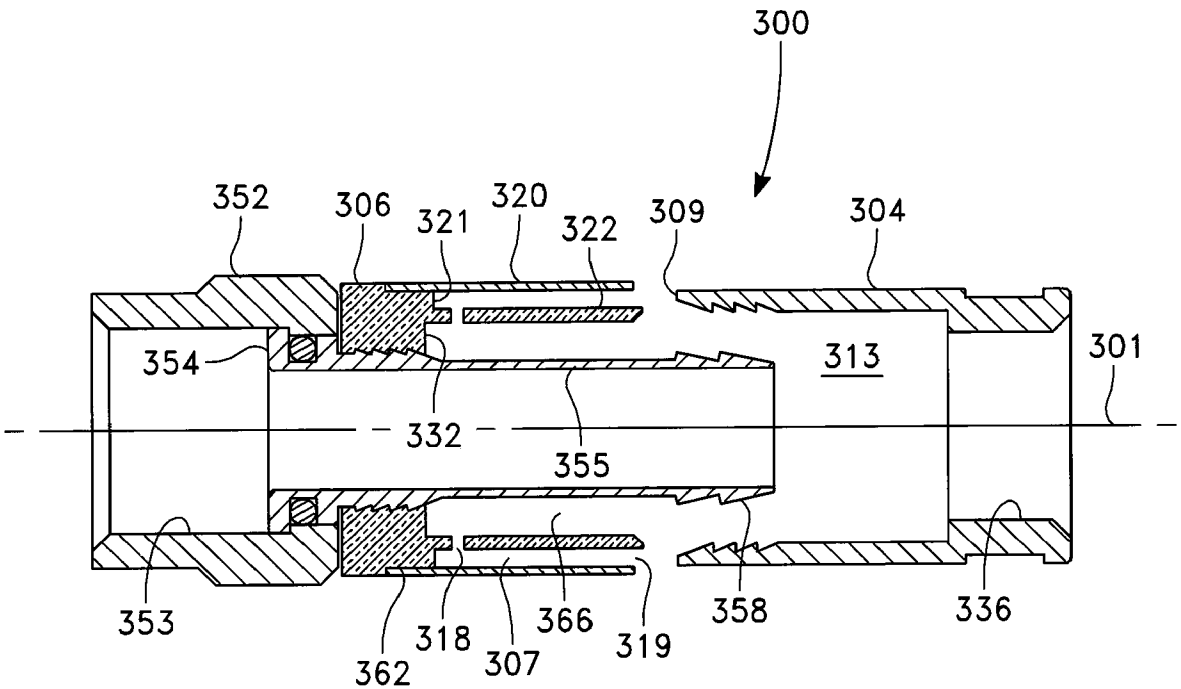
FIG. 3 shows a coaxial cable attachment in accordance with the present invention.
Figure 4:
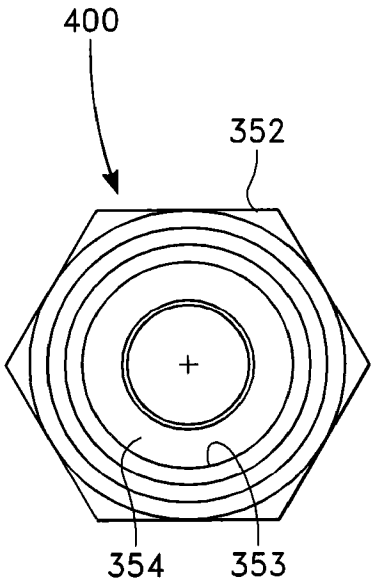
FIG. 4 shows an end view of the cable attachment of FIG. 3.

FIG. 3 shows a coaxial cable attachment for use with filling material in accordance with the present invention 300. FIG. 4 shows an end view of the coaxial cable attachment 400. A fastener 352 rotatably engages a flange 354 of a hollow post 355. Adjacent to the fastener and engaging the post is a body 306 having an inner wall 322 spaced apart from the post and forming an annular space 366. In an embodiment, the fastener has internal threads 353 for connection to a threaded port such as the port of a radio frequency device.

Figure 5:
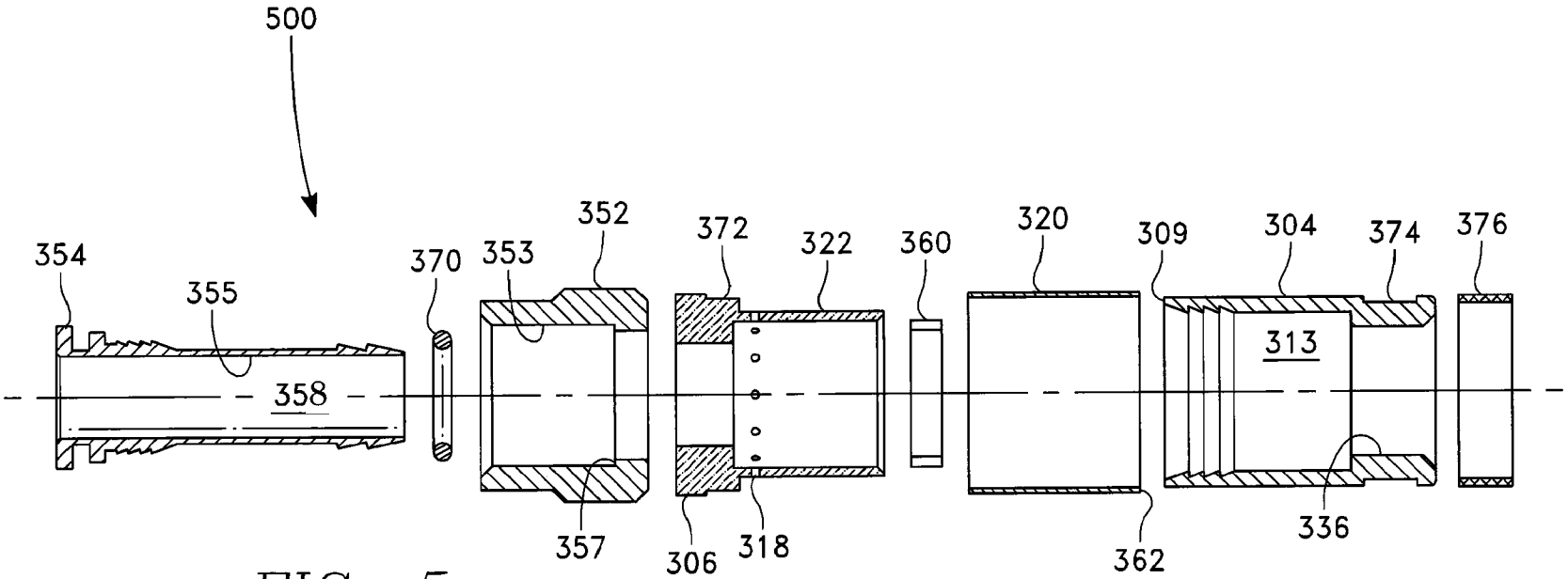
FIG. 5 shows an exploded diagram of parts of the cable attachment of FIG. 3.

FIG. 5 shows an exploded diagram of attachment parts 500 used in the coaxial cable attachment of FIG. 3. The post 355 rotatably couples the fastener 352 to the body 306. In some embodiments, a seal such as an elastomeric O-ring 370 spaces a flange of the post 354 away from an inner shoulder of the fastener 357. One or more ports 318 are located in an inner wall of the body 322 and in some embodiments, an elastomeric ring 360 presses against the ports to form a valve at each port. As shown, the sleeve 362 is fitted over an outer shoulder 372 of the body 306 to form the outer wall of the body 320. An annular opening 319 between the inner and outer walls of the body provides a space for insertion of an end 309 of a plunger 304. A removable elastomeric band 376 provides a means for marking the attachment when it is fitted to an outer recess 374 of the plunger.

In various embodiments, the cable attachment parts 300, 500 are made from one or more of metals and polymers such as the exemplary metals and non-metals discussed above and metals and polymers known by persons of ordinary skill in the art to be suited to this use. In an embodiment, the cable attachment is made from a metal such as one or more of the exemplary metals listed above, for example, brass. In another embodiment, the cable attachment is made from one or more of the exemplary polymers and plastics listed above, for example, POM. And, in some embodiments, the cable attachment parts are made from both metals and plastics. In an embodiment, the plunger 304, sleeve 362, fastener 352, and post 355 are made from a metal such as brass and the body 306 is made from a plastic such as polyoxymethylene ("POM").

The body 306 and the plunger 304 are symmetrically arranged about a central axis 301. The outer sleeve 362 is integral with or mates with (as shown) the body and provides an outer body wall 320 spaced apart from the inner body wall 322. The inner and outer body walls bound a reservoir such as an annular reservoir 307 and the reservoir surrounds all of or a portion of a space such as an annular space 366 about the post 355.

The plunger 304 has a plunger central cavity 313 and a first end 309, opposite a second end 327, is shaped for insertion into an open end 319 of the body reservoir 307. Opposite the open end of the reservoir is a closed reservoir end 321.

Figure 6:
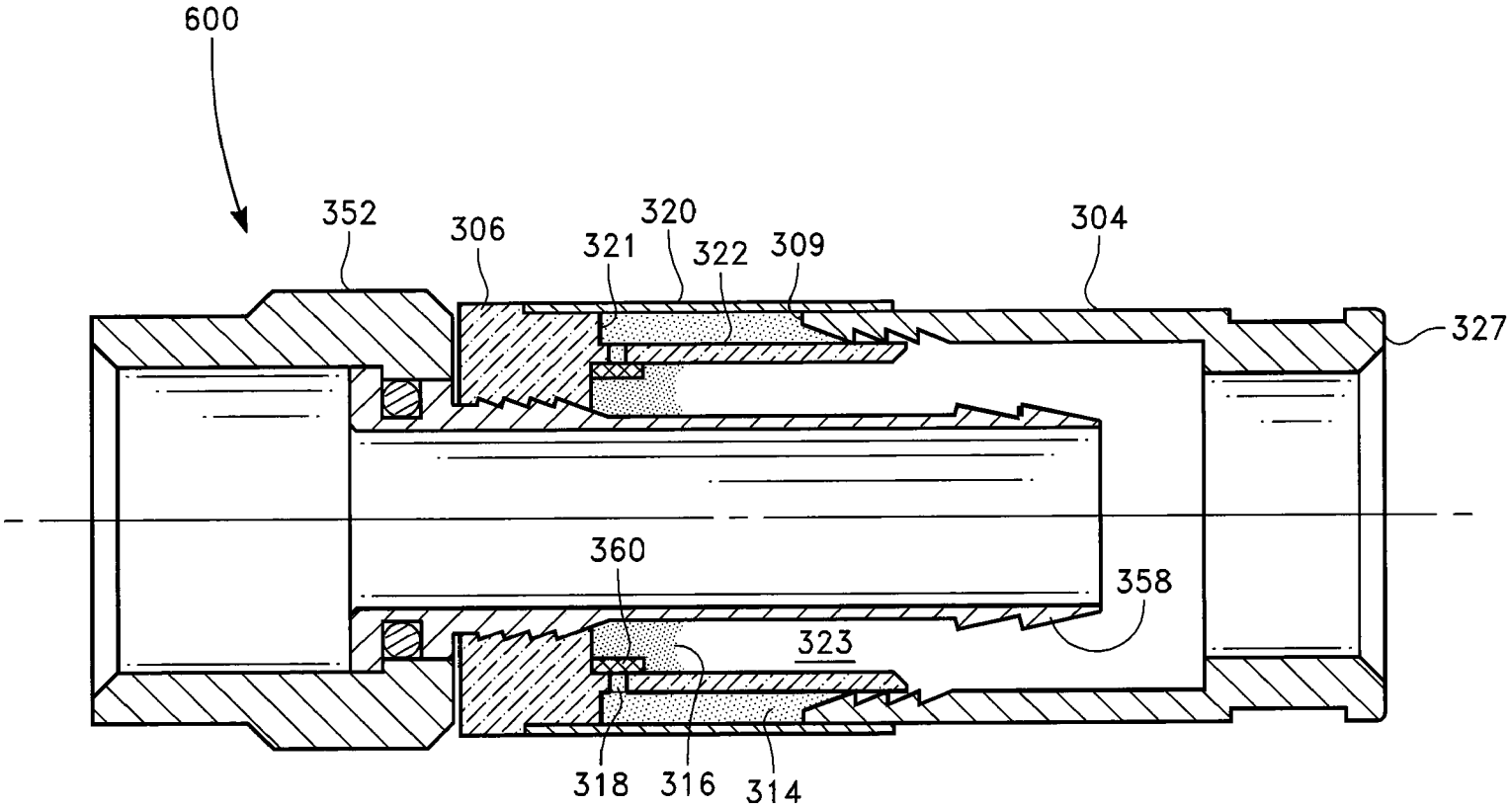
FIG. 6 shows the cable attachment of FIG. 3 with filling material.

FIG. 6 shows the plunger partially inserted in the reservoir 600 (see also FIGS. 3, 5). A first filling material 314 is located in the reservoir 307 such that as the plunger 304 is moved toward the closed end of the reservoir 321, an end face such as an annular end face of the plunger 309 will urge the first filling material to flow through one or more ports 318 in the inner wall of the body 322.

Figure 7:
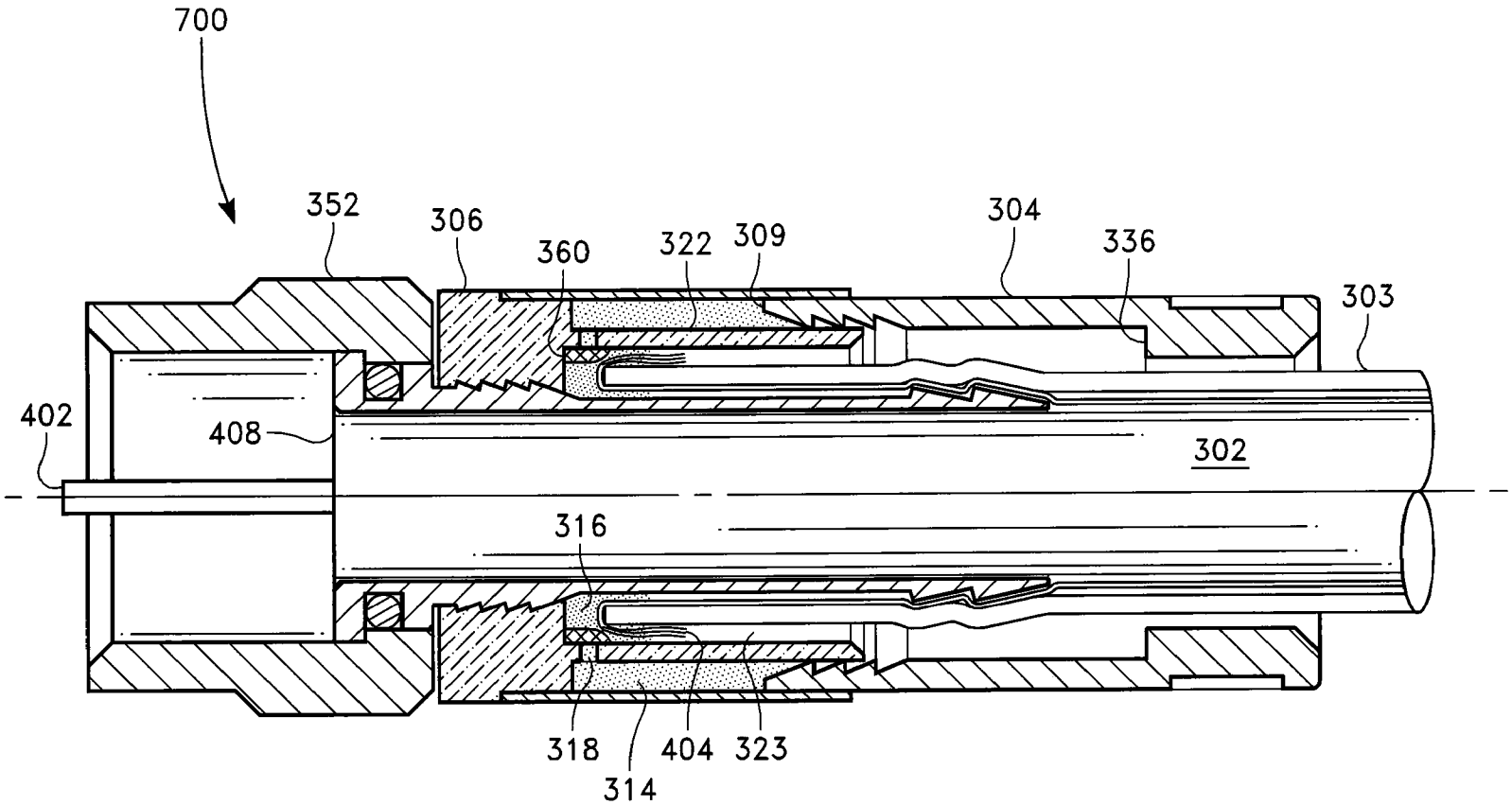
FIG. 7 shows the cable attachment of FIG. 6 with a cable inserted.

FIG. 7 shows a coaxial cable located in an attachment 700 (see also FIGS. 3, 5, 6). When the cable is inserted in the attachment, the barbed end of the hollow post 358 (see FIG. 6) is inserted in the end of the cable 408 such that the post surrounds a portion of the coaxial cable including the cable central conductor 402 and its insulating/dielectric layer (not shown). Another portion of the coaxial cable including a grounding sheath 404 and a cable outer protective jacket 303 surrounds the post. Insertion of the coaxial cable creates a fill space such as an annular fill space 323 including at least a portion of the space between the cable exterior 303 and the inner wall of the body 306.

As can be seen in this embodiment, preparation of the cable end 408 is such that the cable central conductor 402 will extend through the fastener and the exposed grounding sheath 404 will occupy a portion of the annular fill space 323.

Figure 8:
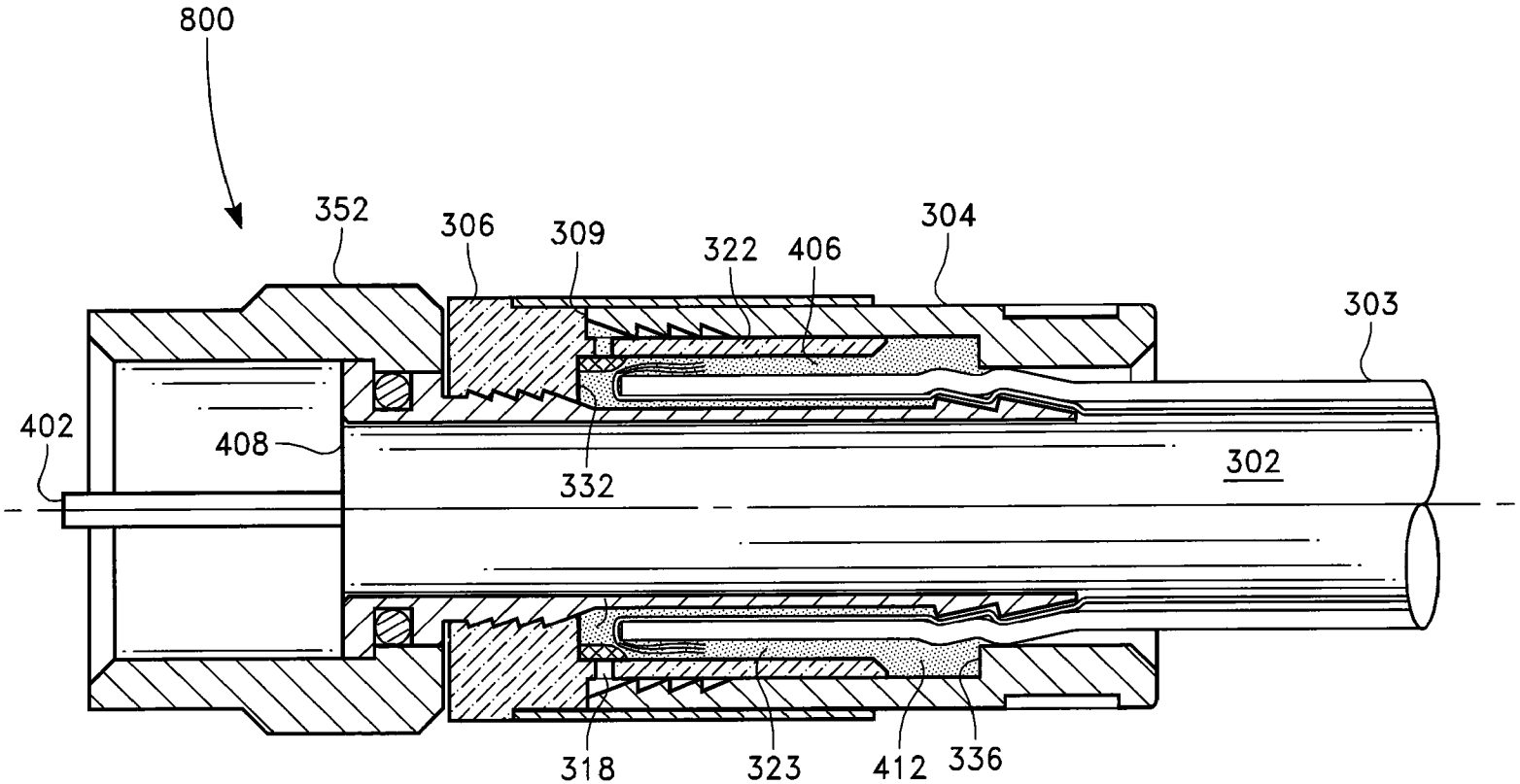
FIG. 8 shows the cable attachment of FIG. 7 after the plunger has been moved.

FIG. 8 shows the attachment after movement of fill material 800 (see also FIGS. 3, 5-7). In particular, moving the plunger toward the reservoir's closed end 321 forces the first filling material 314 through the body inner wall ports 318 and into the annular fill space 323.

In some embodiments, only a first filling material 314 is used. In other embodiments a second filling material 316 is also used. Here, the fill material shown 406 includes, depending on the embodiment, one or both of the first and second filling materials.

In some embodiments, the second filling material 316 can be located in the annular fill space 323 before the second filling material enters the fill space (as shown). In other embodiments, both the first and second filling materials are pushed through the ports 118 by action of the plunger 304. And, in some embodiments, a valve(s) such as a rubber ring or flap 360 is associated with one or more ports 118 and movement of the plunger 104 opens the valve(s). The valve provides a useful feature in some embodiments for limiting exposure of filler material to air and/or for separating one filler material from another.

In various embodiments, filling material 314, 316 is contained by sealing structures adjacent to and/or abutting the cable. In an embodiment, the boundaries of the annular fill space 323 include the cable exterior 303, the body inner wall 322, a portion of a plunger wall 412, a plunger sealing structure 336 and a body sealing structure 332. In various embodiments, one or more sealing structures are used such as any of those described above.

It is not necessary for filling material(s) 314, 316 to completely fill the fill space 323. To the extent the filling material(s) expand and press against the cable exterior 303 and the body 306, relative motion between the cable 102 and the body is limited. And, to the extent the filling materials(s) adhere to the cable exterior and the body, relative motion between the cable and the body is limited. In an embodiment, the filling material(s) provide a barrier against cable 302 and or connector 800 degradation including degradation due to environmental factors such as moisture.

Filling materials include materials known to persons of ordinary skill in the art as being suitable for adhering and/or binding the cable 302 to the body 106 and or to the attachment 300, 600, 700, 800. Filling materials include adhesives and volume expanding fillers.

In particular, filling materials include single and multipart adhesives. Single part adhesives include cyanoacrylate type adhesives such as Krazy Glue®. Two part adhesives include two-part epoxy adhesives such as 3M® Scotch Weld® adhesives including electrical grade adhesives and 3M's quick setting DP100 and DP105 adhesives. Yet another two-part epoxy adhesive is sold by ND Industries, Inc., Troy Mich., under the brand name ND Microspheres® 294, a micro-encapsulated epoxy product.

Filling materials also include volume expanding fillers including single and multipart fillers such as expanding foams including polyisocyanurate and polyurethane two-component expanding sealants from Fomo Products, Inc. of Norton, Ohio sold under the Silent Seal® brand. Yet another two-component expanding polyurethane foam sealant is available from American Industrial Supply Inc. of Burbank, Calif. under the brand AMERFOAM.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

What is claimed is:

1. A cable attachment comprising:

a body having a reservoir at least partially surrounding a central cavity of the body;

a plunger having a central cavity, an end portion of the plunger inserted in the reservoir;

a fluid in the reservoir, a quantity of the fluid capable of being expressed from the reservoir by operation of the plunger;

the central cavities of the body and the plunger operable to receive an electrical cable; and, the fluid operable to limit relative motion between an electrical cable and at least one of the body and the plunger.

2. The cable attachment of claim 1 further comprising:

a hollow post adapted for insertion in an end of a coaxial cable; and, the hollow post extending between a fastener and the body.

3. The cable attachment of claim 2 further comprising:

a coaxial cable inserted in the central cavities of the body and the plunger;

the body and the coaxial cable wetted by fluid expressed from the reservoir; and, the fluid operable to limit relative motion between the coaxial cable and the body.

4. The cable attachment of claim 3 wherein operation of the plunger forms a fixed seal between the plunger and an outer jacket of the coaxial cable.

5. The cable attachment of claim 3 wherein a fluid residue limits the relative motion between the coaxial cable and the body.

6. The cable attachment of claim 3 further comprising:

a wall between the post and the reservoir; and, at least one port in the wall capable of passing the fluid in response to operation of the plunger.

7. The cable attachment of claim 5 wherein the fluid is a component of a single or multi-component adhesive.

8. The cable attachment of claim 5 further comprising:

a mixing part for mixing with the fluid; and, the plunger operable to mix the mixing part and the fluid.

9. The cable attachment of claim 6 further comprising;

a movable seal covering the at least one port; and, the seal capable of passing the fluid in response to operation of the plunger.

10. The cable attachment of claim 8 wherein the mixing part is air.

11. The cable attachment of claim 8 wherein the mixing part is a component of an epoxy adhesive.

12. A method of attaching a connector to a coaxial cable comprising the steps of:

providing a connector body having an annular reservoir surrounding a central cavity;

providing a connector plunger having a central cavity;

supplying the reservoir with a fluid useful in an adhesive filling;

sealing one end of the reservoir with one end of a plunger;

inserting a coaxial cable in the central cavities of the body and the plunger;

operating the plunger to express the fluid into a space separating the coaxial cable and at least one of the body and the plunger; and, transforming a quantity of the fluid into a solid adhering to the coaxial cable and at least one of the body and the plunger.

13. The method of claim 12 further comprising the step of coupling a fastener to the body via a hollow post.

14. The method of claim 13 further comprising the step of forming a seal between the plunger and an outer jacket of the coaxial cable when the plunger is operated.

15. The method of claim 14 further comprising the steps of:

locating a wall between the post and the reservoir; and, forming at least one port in the wall capable of passing the fluid in response to operation of the plunger.

16. The method of claim 15 further comprising the steps of:

providing a mixing part; and, when the plunger is operated, mixing the mixing part with the fluid to transform the fluid into the solid adhesive.

17. The method of claim 15 further comprising the steps of:

providing a port seal in the form of an elastomeric band;

the port seal encircling the wall and covering the at least one port; and, operating the seal to uncover the port when the plunger is operated.

18. The method of claim 16 wherein the mixing part is air.

19. The method of claim 16 wherein the mixing part is a component of an epoxy adhesive.

20. A cable attachment comprising:

a fastener, a hollow post, and a body mechanically coupled together;

the hollow post adapted for insertion in the end of a coaxial cable;

the body having a reservoir at least partially surrounding a central cavity of the body;

a plunger having a central cavity, an end portion of the plunger inserted in the reservoir;

a fluid in the reservoir, a quantity of the fluid capable of being expressed from the reservoir by operation of the plunger;

a coaxial cable inserted in the central cavities of the body and the plunger; and, the fluid operable to limit relative motion between the cable and at least one of the body and the plunger.

21. A cable attachment comprising:

a body having a reservoir at least partially surrounding a central cavity of the body;

a plunger having a central cavity, an end of the plunger inserted in the reservoir;

a coaxial cable inserted in the central cavities of the body and the plunger;

an annular space extending between the cable and a wall bounding the body central cavity;

fluid communication between the reservoir and the annular space enabled by a port in a sidewall of the reservoir;

movement of the plunger operable to transport a filling material from the reservoir to the annular space via the port; and, relative motion between the cable and the body being resisted by the transported filling material.

22. A cable attachment comprising:

a body having a reservoir at least partially surrounding a central cavity of the body;

a plunger having a central cavity, an end portion of the plunger inserted in the reservoir;

a cable inserted in the body central cavity and the plunger central cavity;

an annular space between the cable and at least one of the body and plunger central cavities;

fluid communication between the reservoir and the annular space enabled by a radial port in a sidewall of the reservoir;

a movement of the plunger operable to cause transport of a filling material from the reservoir to the annular space; and, resistance to relative motion between the cable at least one of the body and the plunger being improved by the transport of the filling material.

23. The cable attachment of claim 22 wherein transported filling material protects at least one of the cable and the connector from degrading due to moisture.

24. The cable attachment of claim 22 wherein the filling material is an expanding foam.

25. The cable attachment of claim 22 wherein the filling material is an adhesive.

26. A cable attachment comprising:

a body having a reservoir at least partially surrounding a central cavity of the body;

a plunger having a central cavity, an end portion of the plunger filling a mouth of the reservoir;

a fluid in the reservoir, a quantity of the fluid capable of being forced outside the reservoir by operation of the plunger;

the central cavities of the body and the plunger operable to receive an electrical cable; and, the fluid operable to limit relative motion between an electrical cable and at least one of the body and the plunger.

27. A method of attaching a connector to a coaxial cable comprising the steps of:

providing a connector body having an annular reservoir surrounding a central cavity;

providing a connector plunger having a central cavity;

supplying the reservoir with a fluid useful in an adhesive filling;

sealing one end of the reservoir with one end of a plunger;

inserting a coaxial cable in the central cavities of the body and the plunger;

operating the plunger to force fluid out of the reservoir and into a space separating the coaxial cable and at least one of the body and the plunger; and, transforming a quantity of the fluid into a solid adhering to the coaxial cable and at least one of the body and the plunger.

* * * * *